US010711406B2

(12) United States Patent
Mattson et al.

(10) Patent No.: US 10,711,406 B2
(45) Date of Patent: Jul. 14, 2020

(54) KEYWAY TIE

(71) Applicant: voestalpine Nortrak Inc., Cheyenne, WY (US)

(72) Inventors: Steven R. Mattson, Cheyenne, WY (US); Scott D. Lesher, Cheyenne, WY (US)

(73) Assignee: voestalpine Nortrak Inc., Cheyenne, WY (US)

( * ) Notice: Subject to any disclaimer, the term of this patent is extended or adjusted under 35 U.S.C. 154(b) by 256 days.

(21) Appl. No.: 15/867,623

(22) Filed: Jan. 10, 2018

(65) Prior Publication Data

US 2019/0211512 A1 Jul. 11, 2019

(51) Int. Cl.

| | |
|---|---|
| ***E01B 35/00*** | (2006.01) |
| ***E01B 3/28*** | (2006.01) |
| ***E01B 9/20*** | (2006.01) |
| ***E01B 9/68*** | (2006.01) |
| ***E01B 9/40*** | (2006.01) |
| ***E01B 9/38*** | (2006.01) |
| ***E01B 9/02*** | (2006.01) |
| *E01B 9/48* | (2006.01) |
| *E01B 9/10* | (2006.01) |

(52) U.S. Cl.

CPC ..... *E01B 35/00* (2013.01); *E01B 3/28* (2013.01); *E01B 9/02* (2013.01); *E01B 9/20* (2013.01); *E01B 9/38* (2013.01); *E01B 9/40* (2013.01); *E01B 9/68* (2013.01); *E01B 9/10* (2013.01); *E01B 9/483* (2013.01); *E01B 9/486* (2013.01)

(58) Field of Classification Search

CPC ..... E01B 3/00; E01B 3/02; E01B 3/10; E01B 3/28; E01B 3/32; E01B 3/44; E01B 9/00; E01B 9/02; E01B 9/10; E01B 9/12; E01B 9/14; E01B 9/38; E01B 35/00; E01B 35/12

See application file for complete search history.

(56) References Cited

U.S. PATENT DOCUMENTS

| | | | |
|---|---|---|---|
| 715,698 | A | 12/1902 | Saleme |
| 961,917 | A | 6/1910 | Vaughn |

(Continued)

FOREIGN PATENT DOCUMENTS

| | | | |
|---|---|---|---|
| BE | 559994 | A | 8/1957 |
| CA | 1042402 | A | 11/1978 |

(Continued)

OTHER PUBLICATIONS

International Search Report and Written Opinion dated May 31, 2019 for corresponding International Patent Application No. PCT/US2018/066827, filed Dec. 20, 2018, pp. 19.

*Primary Examiner* — Robert J McCarry, Jr.

(74) *Attorney, Agent, or Firm* — Lowe Graham Jones PLLC

(57) ABSTRACT

A tie having a non-linear keyway under the overlying rail to provide support to restrain lateral and longitudinal movement of the rail. A fastening system to hold rails down on a tie comprises a rail plate that may be fastened to the tie within the keyway. The fasteners are protected to avoid damage in case of a derailment or other adverse conditions. Also disclosed are visual inspection mechanisms to assist with determining whether a fastening system is securely attached to the tie.

38 Claims, 11 Drawing Sheets

(56) References Cited

U.S. PATENT DOCUMENTS

| | | | | | |
|---|---|---|---|---|---|
| 1,069,120 | A * | 8/1913 | Fleissner | A63H 18/02 | 238/100 |
| 1,169,715 | A | 1/1916 | Erickson | | |
| 2,242,773 | A | 5/1941 | Boyce | | |
| 2,276,799 | A | 3/1942 | Spencer | | |
| 2,631,784 | A * | 3/1953 | Anderson | E01B 3/42 | 238/84 |
| 2,779,543 | A * | 1/1957 | Gronlund | E01B 3/42 | 238/86 |
| 3,888,414 | A * | 6/1975 | Duchemin | E01B 9/306 | 238/349 |
| 3,957,201 | A | 5/1976 | Johnson | | |
| 4,108,378 | A | 8/1978 | Raymond | | |
| 4,925,094 | A | 5/1990 | Buekett | | |
| 8,625,878 | B2 | 1/2014 | Haas | | |
| 9,441,956 | B2 | 11/2016 | Kainer | | |
| 9,758,932 | B2 | 11/2017 | Lu et al. | | |
| 2012/0192756 | A1 | 8/2012 | Miller et al. | | |
| 2016/0083911 | A1 * | 3/2016 | Pieringer | E01B 1/002 | 238/37 |

FOREIGN PATENT DOCUMENTS

| | | | |
|---|---|---|---|
| DE | 2554625 | A1 | 6/1976 |
| DE | 102015012573 | A1 | 3/2017 |
| EP | 1384812 | A2 | 1/2004 |
| ES | 2574538 | A1 | 6/2016 |
| JP | 51-156104 | U | 12/1976 |

* cited by examiner

KEYWAY TIE

FIELD OF THE INVENTION

This invention relates to railway ties. In particular, this invention relates to railway ties having a keyway below an overlying rail to constrain lateral and longitudinal movement of the rail. The invention also provides a means to attach the rail plate and pad to the tie in which the attachment means is protected from damage. The invention also provides an inspection mechanism for determination of whether the assembly is properly secured to the tie.

BACKGROUND OF THE INVENTION

As a train runs along a set of rails, it applies lateral forces to the rails, pushing them outward at the point where they are fastened to the supporting ties. It is obviously desirable to minimize the effect of these lateral forces, as any excessive movement of the rail will move the rails heads apart, widening the gauge of the track and allowing the train wheels to slip off the inside of the rail, causing a derailment. Of equal concern is the longitudinal force applied to the rail as the train runs along the rails and due to temperature changes. This force tends to push or pull the rail, and the rail plate holding it to the rail, off the edge of the tie, leaving that portion of the rail unsupported and weak, or disrupting the rail anchoring to the tie to resist thermal longitudinal force, again leading to the possibility of a derailment.

It is known to minimize the effects of the train's forces by securing the rails and ties against movement. For example, U.S. Pat. No. 9,758,932 to Lu et al. describes a ballastless track system wherein concrete slabs carrying the rails are provided with a depending structure on its underside that interacts with the underlying base to try to restrain movement of the entire slab and the overlying rails. However, such systems do not restrict the movement of the rails themselves, apart from the entire assembly as a whole. This may be less efficient and effective.

More typically, movement of a rail supported on a tie is directly restricted by holding it down on a rail plate, which usually includes a rail seat to accommodate the base of the rail. The rail or rail plate is in turn secured to the tie by fasteners. The fasteners are generally exposed on the tie, which can simplify the inspection, repair and/or replacement of the fasteners as needed. However, in a derailment, these fasteners are vulnerable to damage when one or more train wheels forcefully impacts the area beside the rail. This can significantly delay repair after a derailment, and the return of the rail to full availability. Simply covering the fasteners can make it very difficult to inspect the assembly throughout its lifetime, in order to confirm that it properly secures the rail or rail plate. If the assembly is not secured or loosens over time, a catastrophic separation of the rail from the tie may occur.

U.S. Pat. No. 2,276,799 to Spencer and U.S. Pat. No. 715,698 to Saleme both provide ties having shaped keyways in their upper surfaces, in order to interlock with components passing over the tie. Saleme discloses a longitudinal passageway through which a rail base is fed. Spencer discloses a lateral passageway, either in a rail plate or in the tie surface, into which a projection on the underside of the rail is fitted and slides horizontally to interlock with the tie or rail plate. The configuration of the rail and the keyed surface are both relatively complex and would not seem to provide the expected lateral support to a rail.

GB Patent No. 1169715 to Waters discloses a rail for which additional lateral support is provided by using a rail with a depending rib that is located in a linear recess extending across the tie, with a resilient pad between the rail and the tie. In another embodiment, Waters provides a standard rail, and a resilient pad having a depending rib that fits into the recess. However, the first embodiment is likely susceptible to abrasion and deterioration between the rail base and the tie, as there is no plate between them. In the second embodiment, having the resilient pad seems to provide less additional lateral support to the rail than would a stiffer or stronger piece, such as the rail base or a rail plate.

U.S. Pat. No. 2,242,773 to Boyce discloses a tie plate with a pair of ribs on an under surface that are embedded in a tie. These are located towards the outer edge of the plate, just outside the rail base. U.S. Pat. No. 4,108,378 to Raymond discloses a rail plate having depending ribs, and a tie having a recess with grooves running across the width of the tie. The rail plate fits into the recess while its depending ribs fit into the grooves, thereby anchoring the plate to the tie and preventing lateral movement. Connection of the tie plate to the tie is provided by wood screws, while spikes secure the rail to the plate. In both of these patents, the depending rib provides additional lateral support to the plate, preventing it from moving sideways on the tie when a train passes. However, the linear shape and straight orientation of the ribs and grooves relative to the tie does not do anything to restrict longitudinal movement of the rail plate on the tie.

U.S. Pat. No. 3,957,201 to Johnson shows a concrete tie having an anchor structure set into a recess and a rail seat formed by base plate. A rail plate pad is located between the anchor and the rail. A threaded stud is attached to the underside of plate, preferably by spot welding, presumably to anchor the anchor structure into the body of the concrete tie. The threaded stud is permanently attached (welding being the preferred method) and evidently intended to be completely embedded and not accessible for repairs or replacement.

U.S. Pat. No. 4,925,094 to Buekett similarly discloses a concrete tie with a cast-in rail plate defining a rail seat, with downwardly projecting lugs embedded in the tie body. The lugs are provided to ensure a mechanical connection between the plate and the tie. Again, due to the nature of the tie and the connection with the lugs, removal of the rail plate for replacement or repair is not feasible.

U.S. Pat. No. 8,625,878 to Haas et al. describes an inspection system for a railway track that uses vision technology to read and compare a configuration of rail components with safety requirements stored in an associated processor. Similarly, U.S. Pat. No. 9,441,956 to Kainer et al. discloses a tie inspection system that uses a generated light to produce an image of the tie in order to compare it with stored parameters. U.S. Pub. No. 2012/0192756 to Miller et al. discloses a vision-based inspection system mounted on a railcar or other vehicle. However, all of these systems are relatively complex and require computer processing resources, along with the associated time and cost limitations. A visual inspection to ensure that the rail components are in place is a simpler and less expensive alternative.

It is therefore an object of this invention to provide a tie and a rail fastening assembly that overcomes the foregoing deficiencies.

It is a further object of the invention to provide a fastening system that does not require traditional insulators between the rail and clip, yet still provides rail-to-rail electrical isolation.

It is further an object of the invention to provide a system wherein lateral and longitudinal forces of passing trains are transmitted from the rail into the tie, not into the plate-to-tie fastening system. Although concrete ties historically do not use rail plates between the rail and the tie, the use of a plate will significantly reduce or even eliminate rail seat deterioration as it reduces the stresses that pass from the rail base into the concrete. Using a rail plate significantly increases the contact area (plate to concrete tie) as compared to the contact area of a rail base directly on the concrete tie, thus helping to spread the forces from the rail plate over a larger area of the tie and therefore reducing or eliminating abrasion of the concrete.

It is a further object of the invention to provide a system in which alternate fastening systems may be employed simply by changing the rail plate, rather than the tie.

It is a further object of the invention to provide a plate-to-tie fastening system that requires only a minor amount of clamping or connecting force; however, if a fastener is used, a single fastener may be all that is required to provide the needed force to retain the tie plate on the tie. Additional means may be used to prevent loosening of the fastener.

It is a further object of the invention to provide a fastening system located to protect it from damage, for example during a derailment.

It is a further object of the invention to provide a rail plate and rail pad that facilitate inspection of the assembly in place on a tie, when used together.

It is yet a further object of the invention to provide a mechanism to allow easy verification of whether the fastening system is properly retaining the plate and rail on the tie.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

The invention comprises a fastening system, to hold rails down on a concrete tie. A keyway, which preferably has a non-linear shape, is provided under each rail, across the width of the tie. The keyway is preferably narrower than the width of the rail base and accommodates a rail plate, which has a lower surface comprising a depending portion shaped to fit into the keyway in the tie, thus holding the rail plate and rail in place on the tie, while transmitting lateral and longitudinal forces from a passing train down into the tie, rather than into the rail and rail base alone. The bulk of the rail plate does not fit into the keyway, instead having an upper surface comprising a recess bounded by a pair of shoulders shaped to hold the rail base and to support a pair of rail clips that will hold the rail to the rail plate. Neither the rail clips nor the rail shoulders are therefore in direct contact with the tie.

A rail plate pad is provided between the rail plate and the tie surface, lining the inner surfaces of the keyway as well as the upper surface of the tie underneath the rail plate, to protect the tie from abrasion, to dissipate loads and to provide shock absorption. The pad thickness, hardness, internal geometry (shape factor) and other properties may be selected to provide desired track deflection, vertically and laterally, without the need to adjust the tie recess, tie size or other components of the assembly.

Due to the shape of the keyway, it is possible to simply place the rail plate pad and rail plate within the keyway and omit attachment means, while still sufficiently restraining lateral and longitudinal movement of the tie plate on the tie. As this may allow separation of the tie from the plate, an alternative embodiment includes one or more bolt holes within the keyway to accommodate bolts that pass from the rail plate and through the rail plate pad into the tie. The bolt heads may be covered or capped for security and to prevent them from contacting the underside of the rail base. The bolt cover may be keyed, to prevent or minimize loosening of the bolt. The bolt cover may cover the heads of individual fasteners, or may cover most or all of the rail seat. A gauge adjusting mechanism may be provided as part of the bolt cap. The positioning of the bolts under the rail provides an extremely protected area in which the bolts will not be damaged in case of a derailment, which can simplify recovery efforts, making it faster and easier to get a section of track back into operation after a derailment.

In another embodiment, similar protection against derailment damage may be provided for attachment means located on top of the tie plate and outside of the rail base.

In another aspect of the invention, the rail plate and the rail plate pad may be provided with an inspection mechanism, which allows an observer to quickly determine whether the fasteners are sufficiently retaining the rail plate in the correct position on the upper surface of the tie.

In one aspect, the invention comprises a railway tie having an upper surface to support a rail crossing a longitudinal axis of the tie, comprising at least one keyway in the upper surface wherein the keyway provides support to the rail to restrain the rail from moving along the longitudinal axis and transverse the longitudinal axis. The keyway comprises at least one edge or a plurality of edges, and the edge or at least one of the edges is not perpendicular to the longitudinal axis. The keyway may be shaped like an hourglass.

In a further aspect, the railway tie may comprise a fastening assembly to secure the rail to the tie, the fastening assembly comprising a rail plate having an upper surface and an opposed lower surface; shoulders on the rail plate upper surface to define a rail seat therebetween, the rail seat being configured to accommodate a base of the rail; and at least one recess within the rail seat to accommodate a fastener configured to secure the rail plate to the tie. A cap may be provided, the cap configured to fit within the recess; cover an upper portion of the fastener; and sit at least partially co-planar with or below the rail seat. The cap may itself comprise a recess to accommodate the upper portion of the fastener. The cap recess may be non-circular.

In a further aspect, the rail plate may comprise a protrusion on the lower surface, the protrusion being shaped and sized to fit within the keyway.

In yet a further aspect, the assembly may be provided with a rail pad configured to rest between the lower surface of the rail plate and the keyway.

In yet a further aspect, the assembly may be provided with a rail plate pad configured to rest between the rail seat and the rail. An underside of the rail plate pad may comprise at least one protrusion configured to fit within the recess and to cover an upper portion of the fastener. The protrusion may comprise a recess to accommodate the upper portion of the fastener. The protrusion recess may be non-circular.

In yet a further aspect, the railway tie may further comprise an inspection apparatus to indicate whether the rail plate is secured to the railway tie, the apparatus comprising at least one protrusion on an upper surface of the tie; and at least one aperture on the rail plate, the aperture being aligned with the protrusion such that alignment of the rail plate and the keyway allows the protrusion to extend through the rail plate aperture and be visible above the upper surface of the rail plate; wherein misalignment of the rail plate and the keyway will result in the protrusion receding from the rail plate aperture. The protrusion may be cast as part of the upper surface of the tie, or may be anchored into the upper surface of the tie. In a further aspect, the inspection mechanism may comprise an elongated pin configured to fit through an eye in the protrusion and to extend at least partially across the tie; the pin being further configured to break when the misalignment causes the protrusion to recede from the aperture; and the pin comprising at least one extension configured to be visible in a first position outside the rail plate when the pin is intact, and being further configured to move to a second position when the pin breaks. The protrusion and the aperture may be located within a recess in the rail plate. The recess may be located under a rail seat of the rail plate.

In another aspect, the invention may comprise a fastening assembly for a railway tie to secure a rail to the tie, the fastening assembly comprising a rail plate having an upper surface and an opposed lower surface; shoulders on the rail plate upper surface to define a rail seat therebetween, the rail seat being configured to accommodate a base of the rail and the shoulders being configured to accommodate rail fasteners to hold the rail in the rail seat; at least one recess within the rail plate, either within the rail seat or elsewhere on the rail plate, to accommodate a fastener configured to secure the rail plate to the tie; and a cover configured to overlay an upper portion of the fastener.

In a further aspect, the cover may comprise a cap configured to fit within the recess and to sit at least partially co-planar with or below the upper surface of the rail plate. The cap may comprise a recess to accommodate the upper portion of the fastener. The cap recess may be non-circular. Instead or in addition, the recess and the cap may be non-circular.

In a further aspect, the cover may comprise at least one protrusion from an underside of a rail plate pad configured to rest between the rail seat and the rail. The protrusion may comprise a recess to accommodate the upper portion of the fastener. The recess in the rail plate pad protrusion may be non-circular.

In yet a further aspect, the cover may comprise a cap configured to fit within the recess and to sit at least partially co-planar with or below the upper surface of the rail seat. The cap may comprise a recess to accommodate the upper portion of the fastener. The cap recess may be non-circular. Instead or in addition, the recess and the cap may be non-circular.

In yet a further aspect, the assembly may be provided with a rail pad configured to rest between the lower surface of the rail plate and the keyway.

In yet a further aspect, the assembly may be provided with a rail plate pad configured to rest between the rail seat and the rail.

In yet a further aspect, the assembly may be provided with an inspection apparatus to indicate whether the rail plate is secured to the railway tie, the apparatus comprising: at least one protrusion on an upper surface of the tie; and at least one aperture on the rail plate, the aperture being aligned with the protrusion such that installation of the rail plate on the tie allows the protrusion to extend through the rail plate aperture and be visible above the upper surface of the rail plate; wherein misalignment the rail plate on the tie will result in the protrusion receding from the rail plate aperture. The protrusion may be cast as part of the upper surface of the tie, or may be anchored into the upper surface of the tie. The inspection mechanism may further comprise an elongated pin configured to fit through an eye in the protrusion and to extend at least partially across the tie; the pin being further configured to break when the misalignment causes the protrusion to recede from the aperture; and the pin comprising at least one extension configured to be visible in a first position outside the rail plate when the pin is intact, and being further configured to move to a second position when the pin breaks. The protrusion and the aperture may be located within a recess in the rail plate. The recess may be located under a rail seat of the rail plate.

In a further aspect, the rail plate may comprise a protrusion on the lower surface, the protrusion being shaped and sized to fit within a keyway on an upper surface of the tie.

In another aspect, the invention comprises an inspection apparatus to indicate whether a rail plate is secured to a railway tie, the apparatus comprising at least one aperture on the rail plate, the aperture being aligned with the protrusion such that installation of the rail plate and the rail plate pad on the tie allows the protrusion to extend through the aperture and be visible above an upper surface of the rail plate; wherein misalignment of the rail plate and the tie will result in the protrusion receding from the aperture. The protrusion may be cast as part of the upper surface of the tie, or may be anchored into the upper surface of the tie. The inspection apparatus may further comprise a rail plate pad configured to fit between the rail plate and the tie. The rail plate pad may further comprise at least one aperture aligned with the rail plate aperture and adapted to accommodate the tie protrusion.

In a further aspect, the inspection mechanism may further comprise an elongated pin configured to fit through an eye in the at least one protrusion and to extend at least partially across the tie; the pin being further configured to break when the misalignment causes the protrusion to recede from the aperture; and the pin comprising at least one extension configured to be visible in a first position outside the rail plate when the pin is intact, and being further configured to move to a second position when the pin breaks. The protrusion and the aperture may be located within a recess in the rail plate. The recess may be located under a rail seat of the rail plate.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
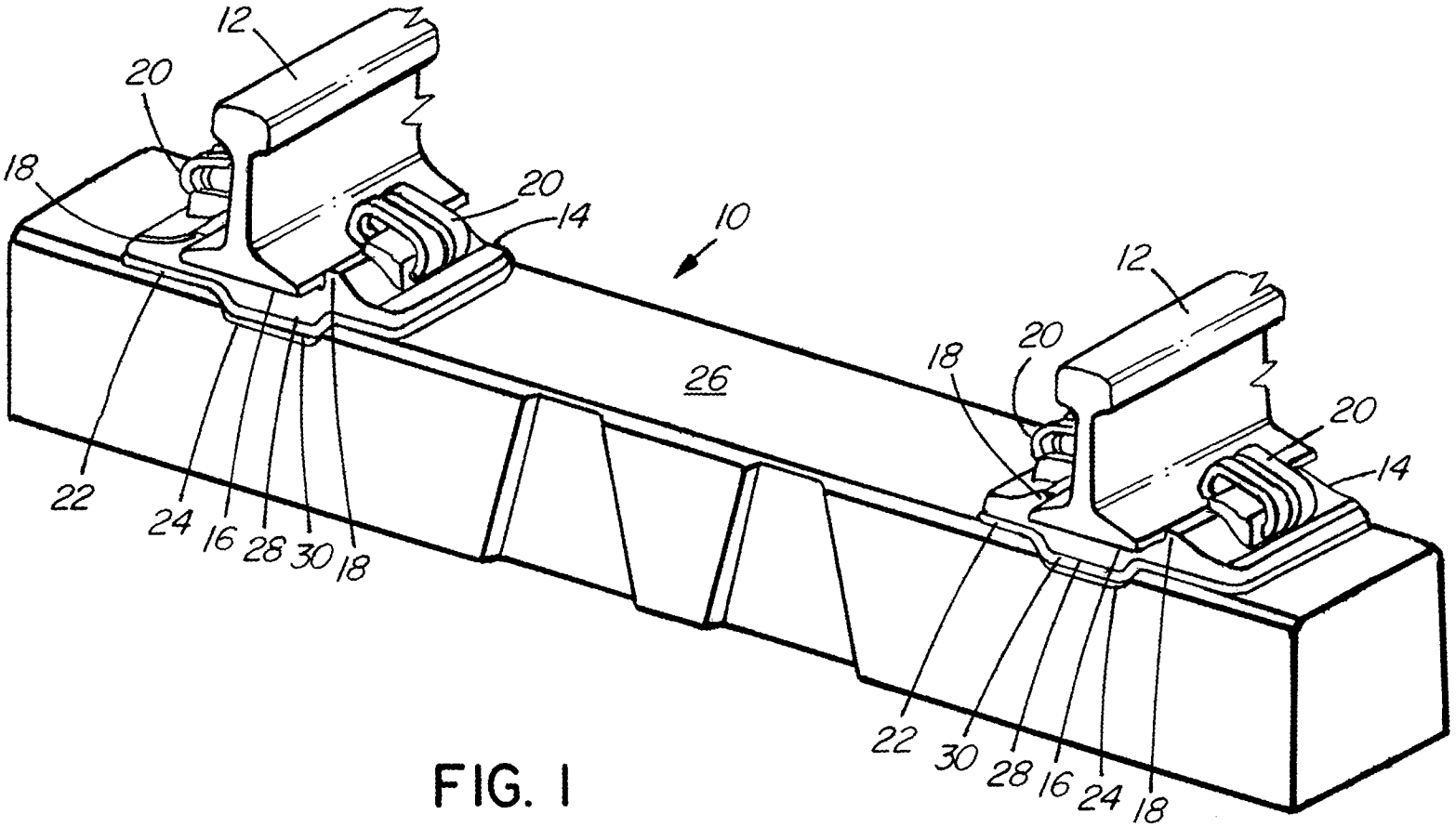
FIG. 1 is a perspective view of a railway tie having the keyway and a first embodiment of the rail fastening assembly of the invention.

As best seen in FIG. 1, a typical tie 10 is an elongated body with an upper surface 26 which is crossed by a pair of rails 12. A rail plate 14 may be provided under the rail 12 for support and stability, and to reduce contact pressures on the upper surface 26 of the tie 10, to reduce or eliminate rail seat deterioration. The rail plate 14 may be fastened to the tie 10 by any suitable, preferably removable, fasteners; several plate fasteners are known and may be used, such as bolts with threaded inserts, snap connections, cables, cast threaded studs, and twist locks, among others. The plate fasteners may be mounted directly on the upper surface 26 of the tie 10, outside of the rail plate 14, as long as they apply sufficient force to hold the rail plate 14 to the tie 10.

The rail plate 14 comprises a rail seat 16 to accommodate the base of rail 12. The rail plate is defined by shoulders 18, which retain rail fasteners, such as clips 20, to hold the base of the rail 12 to the rail plate 14. Shoulders 18 also serve to provide a bearing surface for the edge of rail to bear against, thereby providing gauge restraint. It will be evident that the rail plate 14 carries the means to retain the rail fasteners, avoiding the need to use concrete ties having cast-in shoulders or other inserts, along with specific rail fasteners to match those inserts. The invention therefore provides flexibility, as the type of fastener used can be changed simply by using a different rail plate 14, which can therefore accommodate different rail sizes. Essentially, the tie is "generic", instead of being restricted to the particular type of elastic clip associated with the clip-receiving shoulders or inserts that are cast into the tie. If it is desired to use a different elastic clip, it is possible to merely change out the plates to obtain clip receiving systems compatible with the new preferred clips, rather than having to change the entire tie. The shoulders 18 and associated rail fasteners illustrated are exemplary; several rail fasteners are known and may suitably be used, such as resilient clips driven longitudinal to the rail, resilient clips driven perpendicular to the rail, and resilient clips tensioned via screws or bolts. Production of the tie may also be simpler, as it can be made without worrying about proper insertion of various cast-in shoulders or other inserts for various clip systems. In addition, damaged clip retainers may be repaired or replaced simply by replacing the plate, rather than requiring an entirely new tie.

Cushioning means, such as rail plate pad 22 may be provided between the rail plate 14 and the tie 10. The thickness, hardness, geometry and other properties of rail plate pad 22 may be selected to provide desired track deflection, vertically and laterally.

Figure 2:
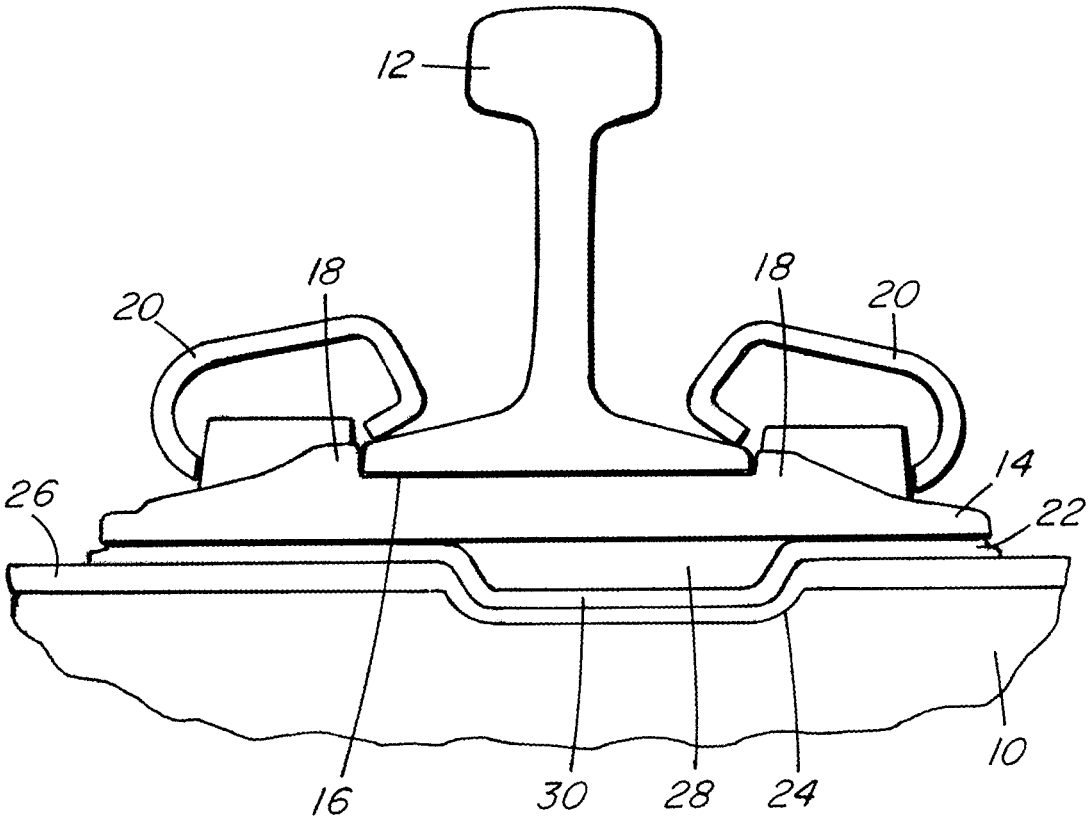
FIG. 2 is a side view of the keyway and rail fastening assembly of FIG. 1.

As best seen in FIG. 2, the lower surface of rail plate 14 is not planar, as it comprises a depending portion 28. The depending portion 28 is shaped to fit within a keyway 24 in the upper surface 26 of tie 10. Rail plate pad 22 is similarly provided with a lower section 30 which is shaped to fit between the keyway 24 and the depending portion 28. It can be seen that the depending portion 28 is not necessarily co-extensive with the base of the rail 12, nor is it necessarily directly underneath the base of rail 12, although either or both may be true in different embodiments. The use of a rail plate will significantly reduce or even eliminate rail seat deterioration as it reduces stresses from rail base into the concrete. Further, by providing a rail plate, the plate to concrete area is significantly greater versus the typical concrete tie rail base to concrete area, which helps to spread the forces from the rail plate over a larger area of the tie, therefore reducing or eliminating abrasion of the concrete.

Figure 3:
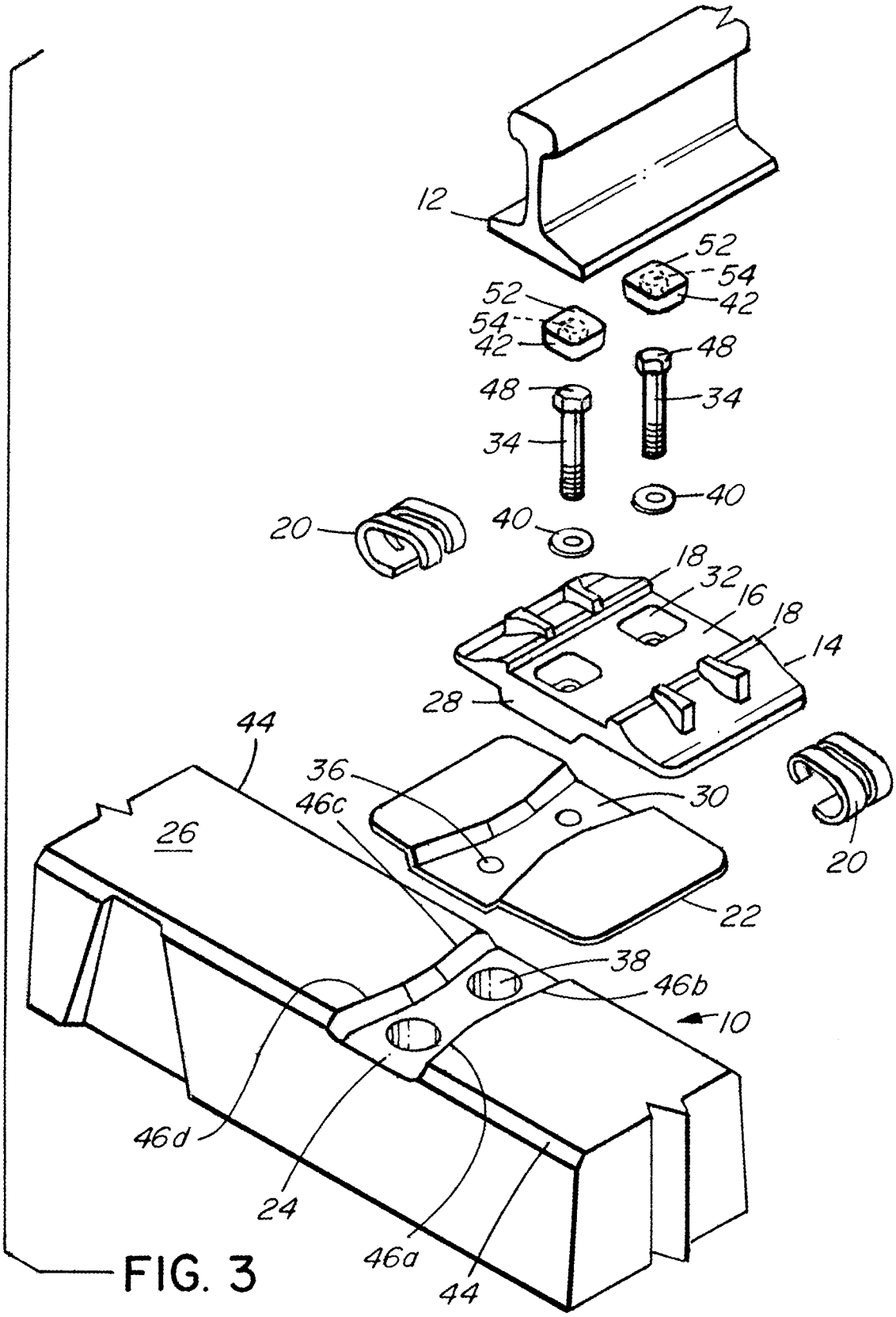
FIG. 3 is an exploded view of the keyway and rail fastening assembly of FIG. 1.

Referring now to FIG. 3, the keyway 24 is preferably a shape that is at least partially more than merely a single straight, linear shape, and has edges that are at least partially not perpendicular to the long edges 44 of the tie 10, which run parallel to the longitudinal axis of the tie 10. In the illustrated embodiment, the edges 46 of keyway 24 are approximately in the shape of an hourglass, which comprises four edges 46*a*, 46*b*, 46*c*, 46*d*, each of which are non-perpendicular relative to the edges 44 of the tie 12. The angled edges will provide both lateral support, i.e. along the axis of the tie 10, and longitudinal support, i.e. along the axis of the rail 12, helping to keep the rail plate 14 (and thus the rail 12) from moving laterally on the tie 10 as well as longitudinally relative to the tie 10. It will be understood that the illustrated hourglass is an effective embodiment, but other shapes having at least one or more non-perpendicular or partially non-perpendicular edges would also be effective. Some exemplary keyway shapes that would also be effective include a polygon, including but not limited to a pentagon, a hexagon or an octagon, an X, a T, an I, a V, a circle, a diamond with angled or rounded edges, a cross or a plus sign. In any case, the keyway 24, and thus the tie 10, absorbs forces transmitted from passing trains, instead of stressing the fasteners holding the assembly to the tie. It will further be understood that the keyway 24 may extend completely across the width of the tie between long edges 44, as shown, but need not do so. More specifically, while it is preferred that the keyway 24 intersect both edges 44, which would be most efficient for draining water away from the rail, it will be understood that the keyway 24 may instead intersect one or neither of long edges 44.

The shape of the keyway may therefore alone provide adequate support to sufficiently limit movement of the rail plate 14 and rail 12 relative to the tie 10. It will be understood that there is some resiliency offered by the plate pad 22 that will allow plate lateral and longitudinal deflection under load. This may allow a concrete tie to behave in a manner similar to wood or may simply offer more resiliency against vibration and also to help distribute the load amongst more ties. In the case of loss of under-tie support, however, additional security is provided to ensure the retention of rail plate 14 on tie 10 through the use of one or more removably secured plate-to-tie fasteners, such as bolts 34. In the embodiment shown in FIG. 3, the plate fasteners 34 are located in the rail seat 16, under the base of the rail 12. One or more recesses 32 may be provided in rail seat 16, with corresponding recesses 36 and 38 provided in rail plate pad 22 and in the tie 10, respectively, to accommodate the plate fasteners 34. Recesses 32 and 36 are preferably somewhat larger than the body of plate fastener 34, allowing some degree of movement of rail plate 14 and rail plate pad 22 about the body of plate fastener 34. This also helps to ensure that forces from passing trains are transmitted into the keyway 24 and the tie 10, rather than into the plate fastener 34. Washers 40 may be provided to assist in securing the plate fasteners 34 through the slightly enlarged recesses.

It can be seen that in this embodiment, any fasteners 34 holding the rail plate 14 and rail plate pad 22 in place on the tie 10 are substantially protected from damage that might be caused, for example, by a train wheel during a derailment. Further protection of the plate-to-tie fasteners 34 may be provided by one or more caps 42, which fit over the top or heads 48 of the plate fasteners 34. The recesses 32 are preferably sized to allow the heads 48 of plate fasteners 34 to lie below the upper surface 50 of the rail seat 16, such that the upper surface 52 of caps 42 is either co-planar with the upper surface 50 or is slightly recessed. This arrangement allows the rail 12 to sit securely within rail seat 16 while still protecting the heads 48 of plate fasteners 34. As can be seen in FIG. 3, recesses 32 and caps 42 may be any suitable shape but are preferably non-circular, which will tend to reduce the likelihood that the caps will rotate or otherwise move under forces applied to the assembly by passing trains. This in turn helps to prevent the plate fasteners 34 from loosening under those forces. In a further aspect, cap 42 may be provided with a non-circular recess 54 on its underside; the non-circular recess 54, which may be hexagonal as an example, will interact with the head 48 of plate fastener 34 to prevent it from turning and therefore loosening.

Figure 4:
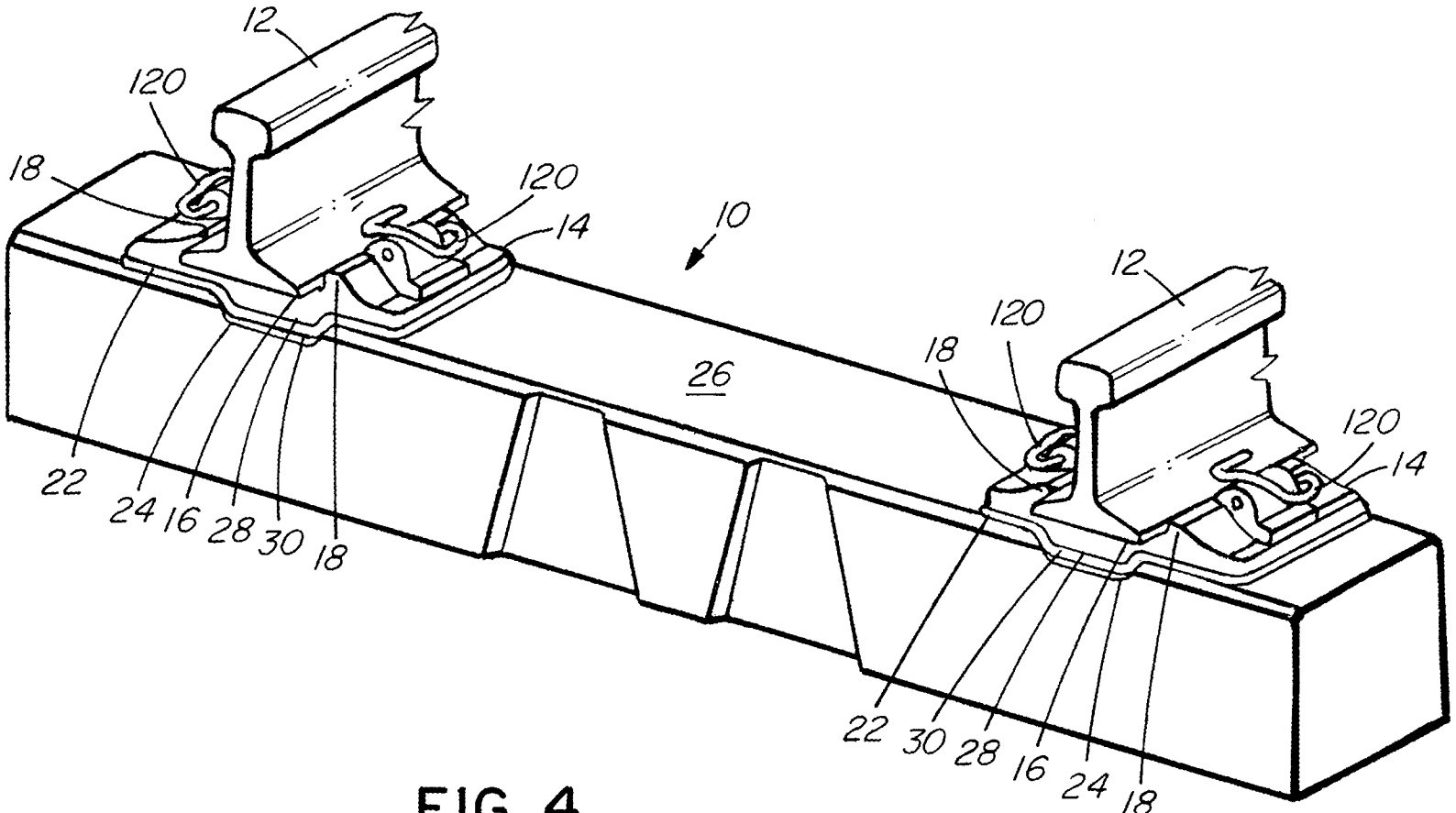
FIG. 4 is a perspective view of a railway tie having the keyway and a second embodiment of the rail fastening assembly of the invention.
Figure 5:
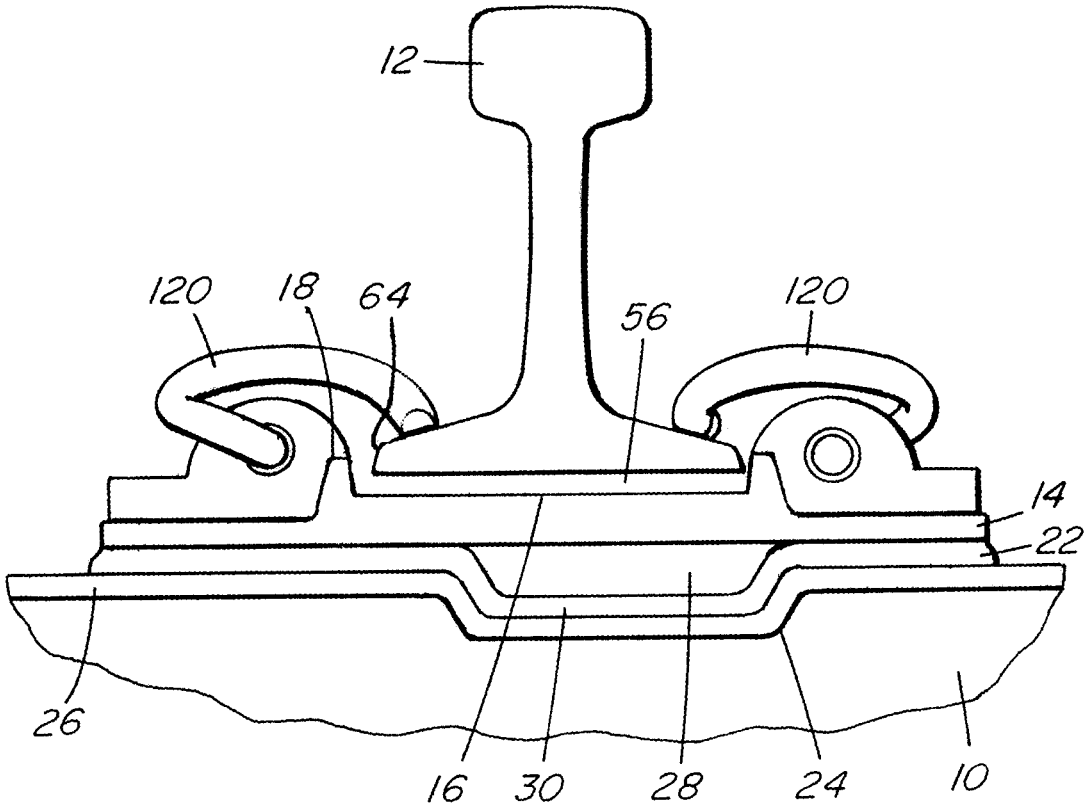
FIG. 5 is a side view of the keyway and rail fastening assembly of FIG. 4.
Figure 6:
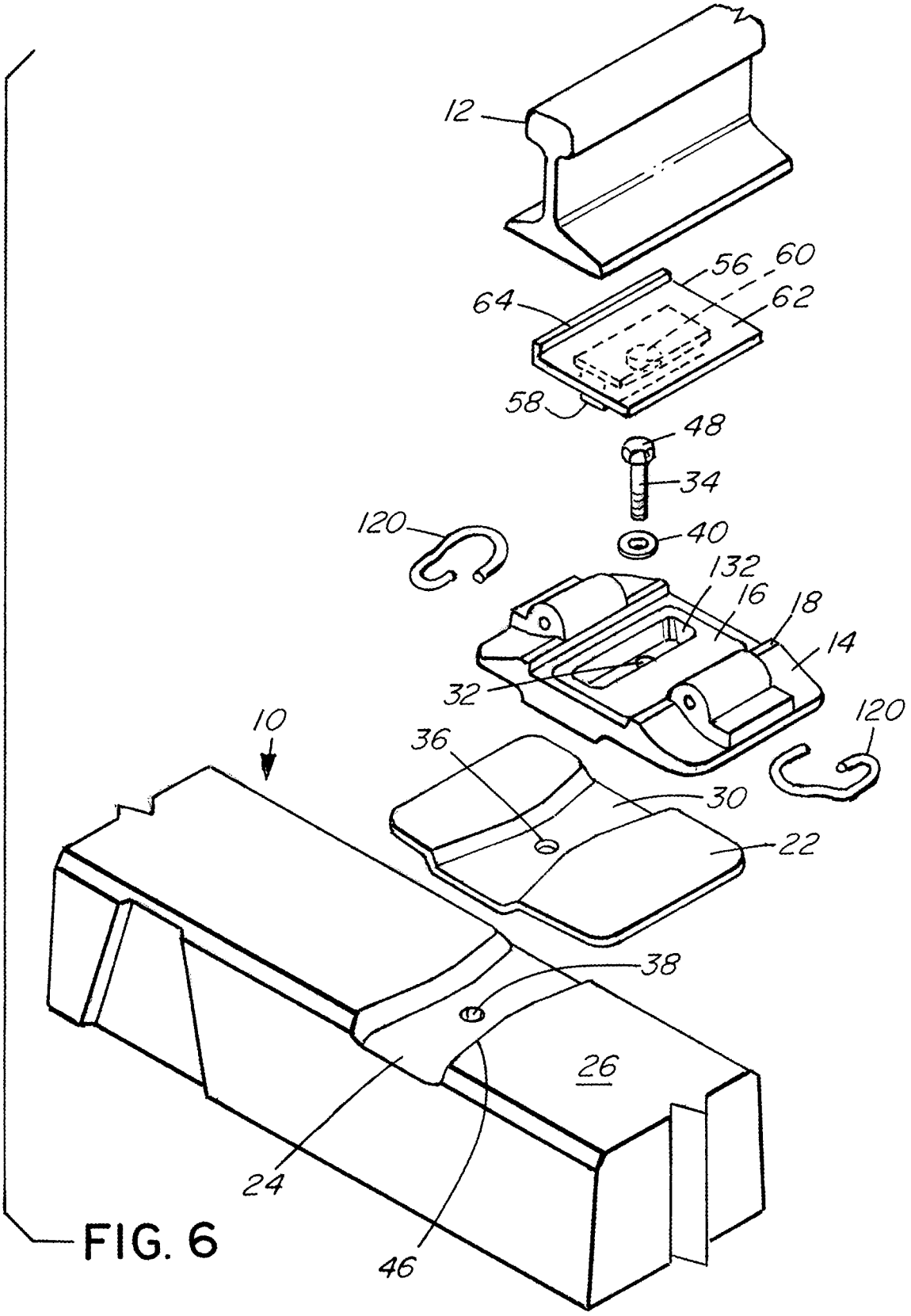
FIG. 6 is an exploded view of the keyway and rail fastening assembly of FIG. 4.

A second embodiment of the invention is shown in FIGS. 4-6. In this and the other embodiments to be described, the same reference numbers are used to denote the same parts as those in the embodiment shown in FIGS. 1-3.

In this embodiment, rail plate 14 is provided with shoulders 18 shaped to accommodate a different type of rail fastener, in this case an e-clip 120. Again, this type of shoulder and rail fastener are exemplary; because the plate is changeable, any suitable rail fasteners may be used, including those that can be driven in a direction perpendicular to the rail, longitudinal to the rail or using tension. Again, the rail fasteners may instead be mounted directly on the upper surface 26 of the tie 10, outside of the rail plate 14, as long as they apply sufficient force to hold the base of the rail 12 to the tie.

FIG. 6 illustrates another embodiment of means by which the plate-to-tie fasteners can be protected, in the form of a rail seat pad 56 that fits in rail seat 16 between shoulders 18. Rail seat pad 56 also cushions the contact between rail 12 and rail plate 14. The underside of rail seat pad 56 may be flat, such that it lies over bolt caps 42 (not shown) as described with respect to the previous embodiment. Alternatively, the underside of rail seat pad 56 may be provided with one or more depending portions 58, shaped to fit into the one or more recesses 132 in rail seat 16 that hold the plate fastener 34 and recess 32. The depending portions 58 may sit on top of cap 42 (not shown) if provided, or depending portions 58 may be provided with one or more recesses 60 to fit directly over the head 48 of one or more plate fasteners 34. Without separate bolt caps, this embodiment may be simpler and less expensive to install.

Rail seat pad 56 may have an upper surface 62 that is substantially flat, or may be provided with one or more raised edges 64. Edges 64 assist with electrical insulation between the rail 12 and the rail plate 14. Edges 64 may be provided in different thicknesses, allowing some amount of gauge adjustability, which can help simplify installation of the rail 12 on the tie 10.

Figure 7:
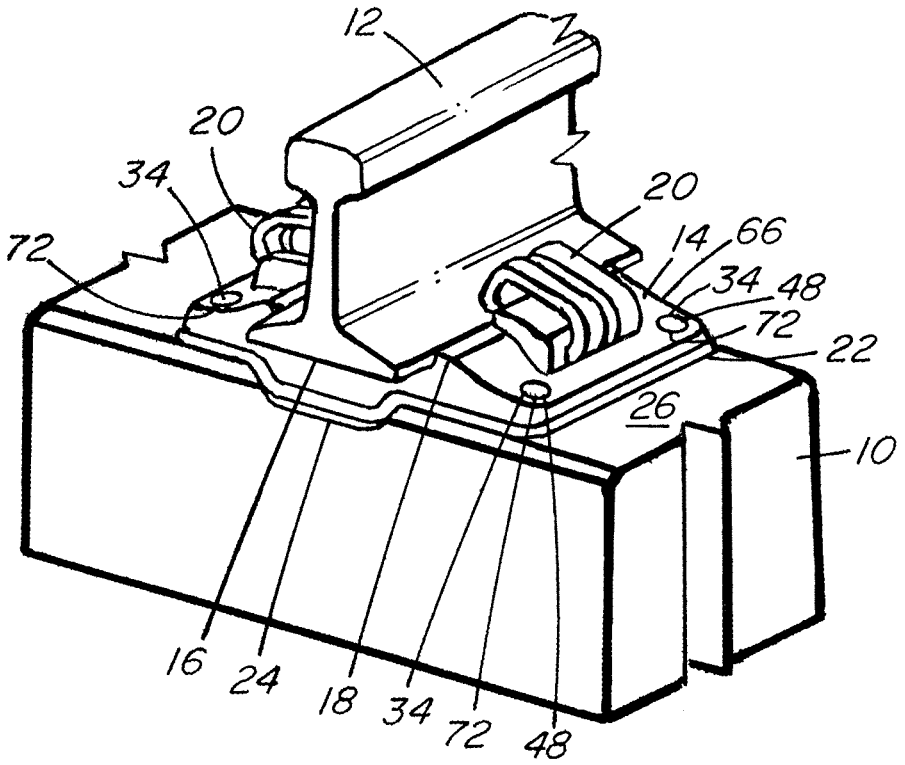
FIG. 7 is a perspective view of a part of a railway tie having the keyway and a third embodiment of the rail fastening assembly of the invention.

Instead of or in addition to providing one or more plate fasteners 34 located under the rail seat, plate fasteners 34 may be located outside of the rail seat 16, as shown in FIG. 7. One or more recesses 72 are provided in rail plate 14 for plate fasteners 34. The recesses 72 are preferably sized to accommodate plate fasteners 34 such that heads 48 lie below the upper surface 66 of the rail plate 14. This provides some protection for the plate fasteners 34 in case of an impact. Further protection may be provided with fastener caps 42 (not shown), as described in previous embodiments. The caps 42 may be co-planar with the upper surface 66, slightly recessed, or proud of the rail bearing surface, which may enhance longitudinal restraint. This arrangement protects the heads 48 of plate fasteners 34 while allowing ready access to the plate fasteners 34 for visual inspection to ensure that the plate fasteners 34 are in place and secure. Recesses 72 and caps 42 may be any suitable shape but are preferably non-circular, which will tend to reduce the likelihood that the caps will rotate or otherwise move under forces applied by passing trains. This in turn helps to prevent the plate fasteners 34 from loosening under those forces.

Figure 8:
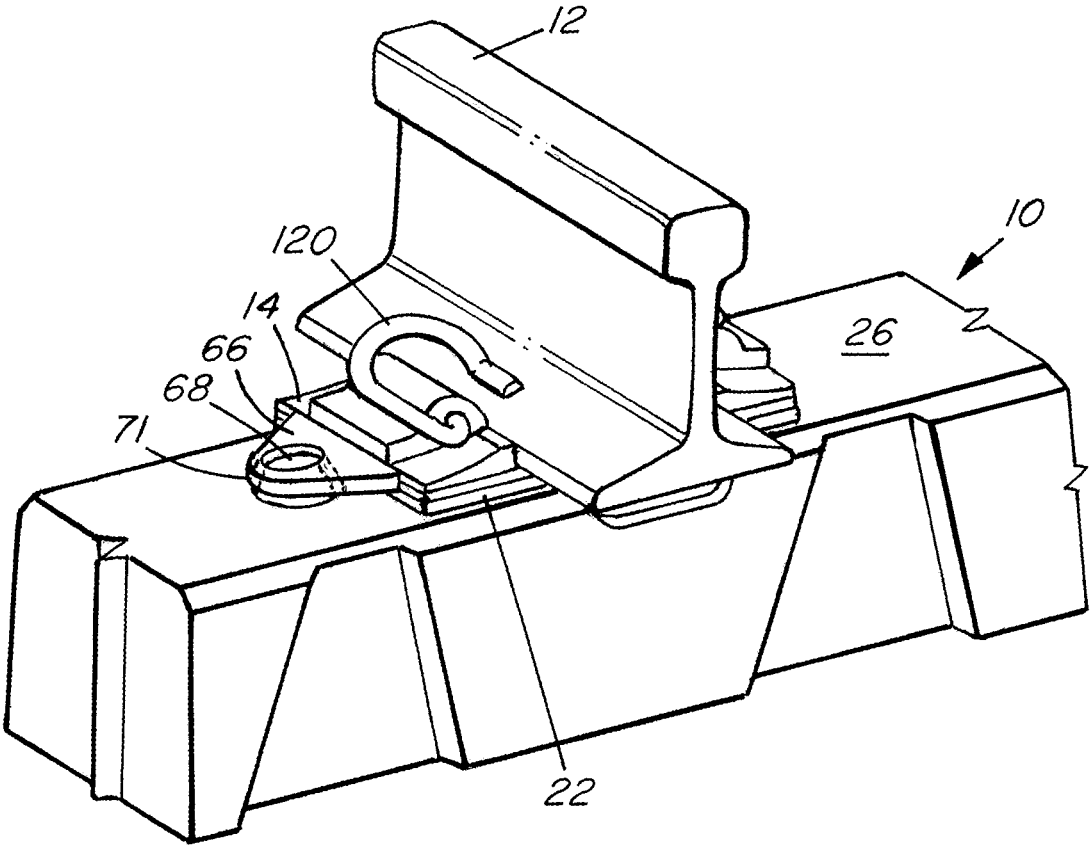
FIG. 8 is a perspective view of a first embodiment of an inspection mechanism of the invention.
Figure 9:
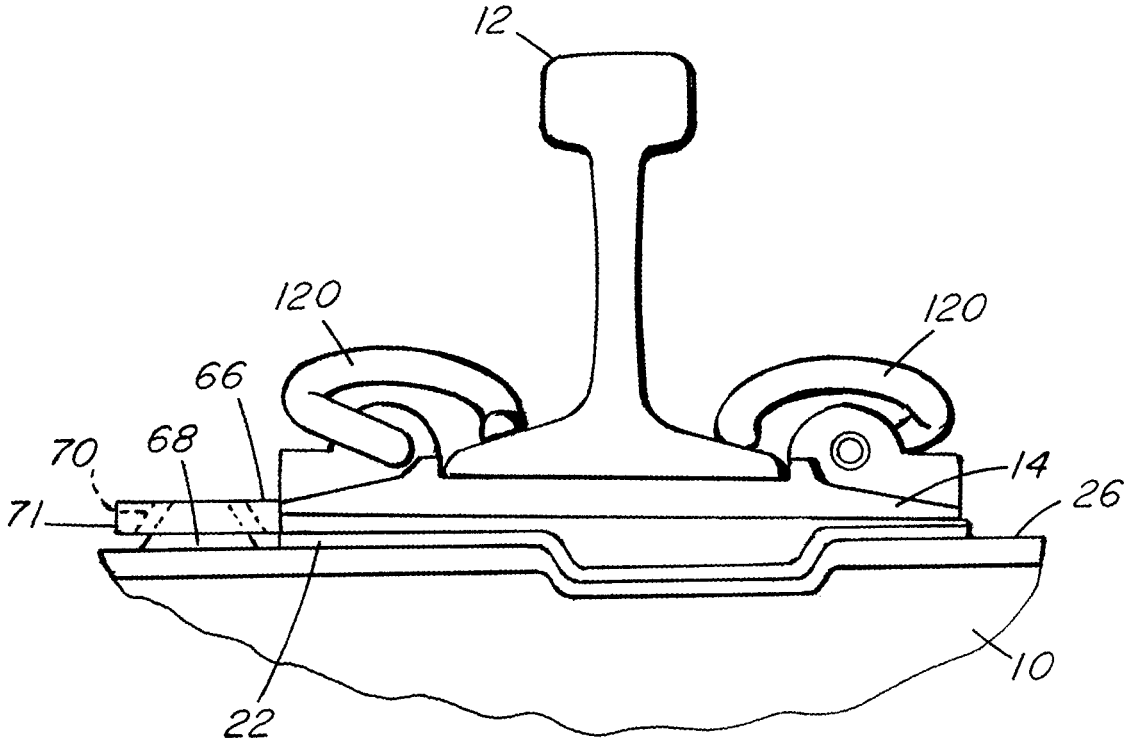
FIG. 9 is a side view of the inspection mechanism of FIG. 8.

An inspection mechanism, best shown in FIGS. 8 and 9, may be particularly useful when the plate fasteners themselves are not readily visible. In one such mechanism, upper surface 26 of tie 10 is provided with one or more upstanding protrusions 68. The protrusion 68 may be cast directly into the upper surface 26, or may be anchored in the concrete of tie 10. The rail plate 14 has at least one aperture 70 which corresponds to a protrusion 68. The aperture 70 may be in the body of the plate 14 or may extend out in a tab 71, as shown, which may be easier to visually monitor. When the plate fasteners 34 (not shown) are fully inserted, the protrusion 68 passes though aperture 70 and is visible through the upper surface 66 of the rail plate 14. If a plate fastener loosens, the rail plate 14 will tend to move upward, and possibly laterally, relative to the rail plate pad 22 when the rail 12 is not under downward pressure from a passing train. The physical separation of the rail plate 14 from the rail plate pad 22 and/or from the upper surface 26 of tie 10 will cause the protrusion 68 to recede below the upper surface 66 of the rail plate 14 or to disengage entirely from the aperture 70. In either case, there is quick visual confirmation that the parts are not properly connected, and an indication that repair or replacement is required.

Figure 10:
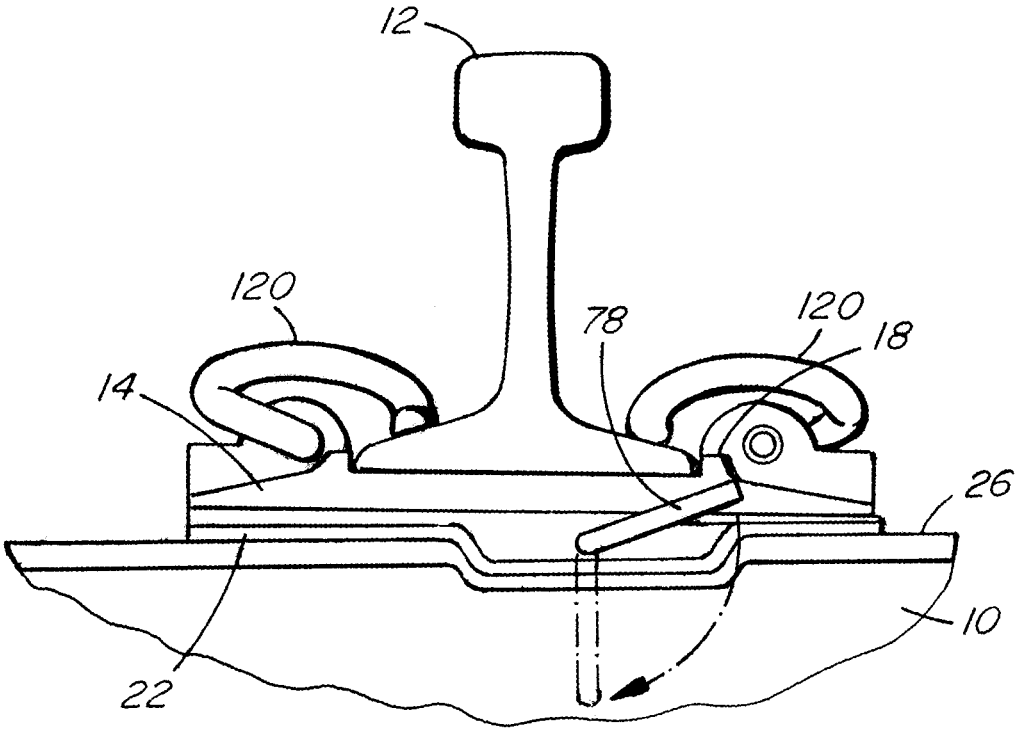
FIG. 10 is a side view of a second embodiment of an inspection mechanism of the invention.
Figure 11:
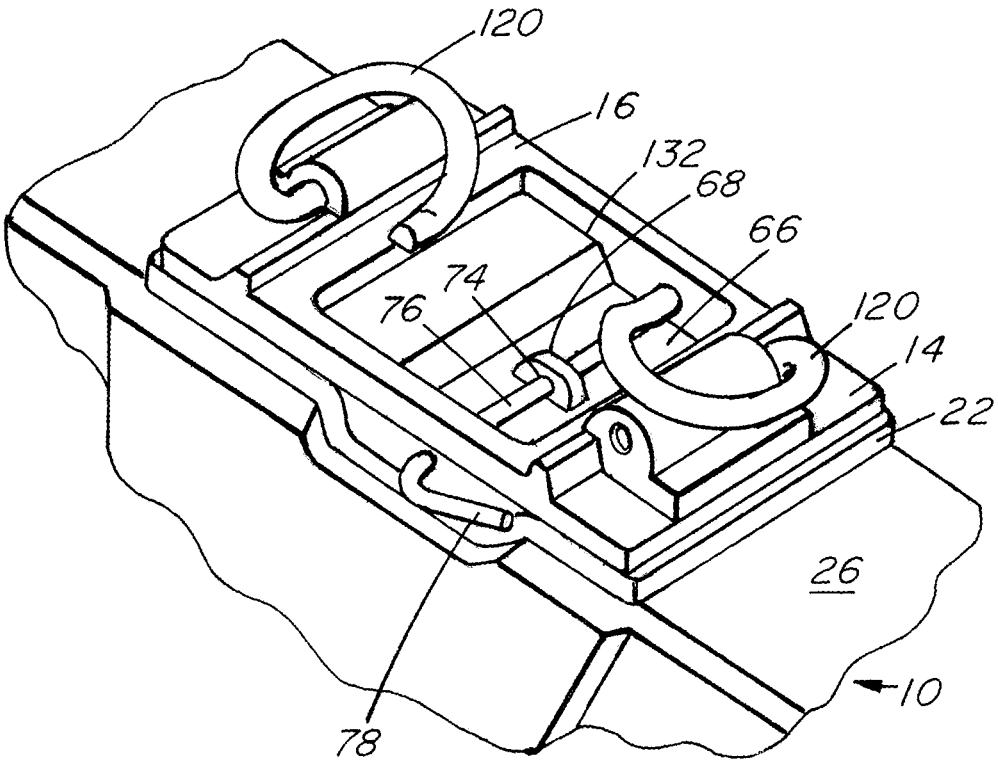
FIG. 11 is an interior view of the inspection mechanism of FIG. 10.

FIGS. 10 and 11 show a second embodiment of the inspection mechanism of the invention. In this embodiment, protrusion 68 is provided with an eye 74, through which an elongated pin 76 may pass. The elongated pin 76 extends such that an extension 78 provided thereon is visible outside of the rail plate 14. Extension 78 is shown as a leg extending from pin 76, but it will be understood that any configuration and placement of extension 78 relative to pin 76 may be used, as long as the extension is visible for inspection. If the rail plate 14 moves upward due to loosening of the plate fasteners 34 (not shown, for clarity), the physical separation of the rail plate 14 from the rail plate pad 22 and/or from the upper surface 26 of tie 10 will cause the protrusion 68 to recede below the upper surface 66 of the rail plate 14, putting pressure on the pin 76 and breaking it. The broken pin is then free to rotate or otherwise move, such that the extension 78 moves from a first position, shown in solid lines in FIG. 10, to a second position, shown in dashed lines in FIG. 10. The pin preferably extends across the tie as in the embodiment shown, which provides more space for the extension 78 to move when the pin 76 breaks, but any configuration in which movement of the extension 78 is readily discernible will be sufficient. Further, in the embodiment shown, the protrusion 68 is provided in the recess 132 underneath a portion of the rail. This may help to isolate the protrusion 68 and pin 76, but these parts may also be placed elsewhere on the rail plate 14.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The embodiments of the invention in which an exclusive property or privilege is claimed are defined as follows:

1. A railway tie having an upper surface to support a rail crossing a longitudinal axis of said tie, said rail being supported on an upper surface of a rail plate, comprising:

at least one keyway in said railway tie upper surface;

wherein a protrusion on a lower surface of said rail plate is accommodated within said keyway, and interaction between said protrusion and said keyway restrains said rail and said rail plate from moving along said longitudinal axis and transverse said longitudinal axis.

2. The railway tie of claim 1, wherein said keyway comprises at least one edge and said edge is not perpendicular to said longitudinal axis.

3. The railway tie of claim 2, wherein said keyway is shaped like an hourglass.

4. The railway tie of claim 1 wherein said keyway comprises a plurality of edges and at least one of said edges is not perpendicular to said longitudinal axis.

5. The railway tie of claim 1, further comprising a fastening assembly to secure said rail to said tie, said fastening assembly comprising:

shoulders on said rail plate upper surface to define a rail seat therebetween, said rail seat being configured to accommodate a base of said rail;

at least one recess within said rail seat to accommodate a fastener configured to secure said rail plate to said tie.

6. The railway tie of claim 5 further comprising a cap configured to:

fit within said recess; and cover an upper portion of said fastener.

7. The railway tie of claim 6 wherein said cap further comprises a recess to accommodate said upper portion of said fastener.

8. The railway tie of claim 7 where said recess in said cap is non-circular.

9. The railway tie of claim 5, wherein said protrusion on said lower surface is shaped and sized to fit within said keyway.

10. The railway tie of claim 5, further comprising a rail plate pad configured to rest between said lower surface of said rail plate and said keyway.

11. The railway tie of claim 5, further comprising a rail seat pad configured to rest between said rail seat and said rail.

12. The railway tie of claim 11 wherein an underside of said rail seat pad comprises at least one protrusion configured to fit within said recess and to cover an upper portion of said fastener.

13. The railway tie of claim 12 wherein said rail seat pad protrusion further comprises a recess to accommodate said upper portion of said fastener.

14. The railway tie of claim 13 where said recess in said rail seat pad protrusion is non-circular.

15. The railway tie of claim 10, further comprising an inspection apparatus to indicate whether said rail plate is secured to said railway tie, said apparatus comprising:

at least one protrusion on said upper surface of said tie; and at least one aperture on said rail plate, said aperture being aligned with said tie protrusion such that alignment of said rail plate and said keyway allows said tie protrusion to extend through said rail plate aperture and be visible above said upper surface of said rail plate;

wherein misalignment of said rail plate and said keyway will result in said tie protrusion receding from said rail plate aperture.

16. The railway tie of claim 15 wherein said tie protrusion is anchored in said tie.

17. The inspection apparatus of claim 15, wherein said protrusion is cast into said upper surface of said tie.

18. The inspection apparatus of claim 15 further comprising:

an elongated pin configured to fit through an eye in said at least one protrusion and to extend at least partially across said tie;

said pin being further configured to break when said misalignment causes said protrusion to recede from said aperture; and said pin comprising at least one extension configured to be visible in a first position outside said rail plate when said pin is intact, and being further configured to move to a second position when said pin breaks.

19. The inspection mechanism of claim 18 wherein said protrusion and said aperture are located within said recess in said rail plate.

20. A fastening assembly for a railway tie to secure a rail to said tie, said fastening assembly comprising:

a rail plate having an upper surface and an opposed lower surface;

shoulders on said rail plate upper surface to define a rail seat therebetween, said rail seat being configured to accommodate a base of said rail and said shoulders being configured to accommodate rail fasteners to hold said rail in said rail seat;

a rail seat pad configured to rest between said rail seat and said rail;

at least one recess within said rail plate to accommodate a fastener configured to secure said rail plate to said tie; and a cover configured to overlay an upper portion of said fastener, said cover comprising at least one protrusion from an underside of said rail seat pad.

21. The fastening assembly of claim 20 wherein said protrusion further comprises a recess to accommodate said upper portion of said fastener.

22. The fastening assembly of claim 21 where said recess in said rail seat pad protrusion is non-circular.

23. The fastening assembly of claim 20, further comprising a rail plate pad configured to rest between said lower surface of said rail plate and said tie.

24. The fastening assembly of claim 20, further comprising an inspection apparatus to indicate whether said rail plate is secured to said tie, said apparatus comprising:

at least one protrusion on an upper surface of said tie; and at least one aperture on said rail plate, said aperture being aligned with said tie protrusion such that installation of said rail plate on said tie allows said tie protrusion to extend through said rail plate aperture and be visible above said upper surface of said rail plate;

wherein misalignment said rail plate on said tie will result in said tie protrusion receding from said rail plate aperture.

25. The fastening assembly of claim 24, wherein said tie protrusion is anchored in said tie.

26. The fastening assembly of claim 24, wherein said protrusion of said inspection apparatus is cast into said upper surface of said tie.

27. The fastening assembly of claim 24, said inspection apparatus further comprising:

an elongated pin configured to fit through an eye in said at least one protrusion and to extend at least partially across said tie;

said pin being further configured to break when said misalignment causes said protrusion to recede from said aperture; and said pin comprising at least one extension configured to be visible in a first position outside said rail plate when said pin is intact, and being further configured to move to a second position when said pin breaks.

28. The fastening assembly of claim 27 wherein said protrusion and said aperture of said inspection apparatus are located within said recess in said rail plate.

29. The fastening assembly of claim 28 wherein said recess of said inspection apparatus is located in said rail seat.

30. The fastening assembly of claim 24, wherein said rail plate further comprises a protrusion on said lower surface, said protrusion being shaped and sized to fit within a keyway on an upper surface of said tie.

31. An inspection apparatus to indicate whether a rail plate is secured to a railway tie, said apparatus comprising:

at least one protrusion on an upper surface of said tie; and at least one aperture on said rail plate, said aperture being aligned with said protrusion such that installation of said rail plate on said tie allows said protrusion to extend through said aperture and be visible above an upper surface of said rail plate;

wherein misalignment of said rail plate and said tie will result in said protrusion receding from said aperture.

32. The inspection apparatus of claim 31, wherein said protrusion is anchored in said upper surface of said tie.

33. The inspection apparatus of claim 31, wherein said protrusion is cast into said upper surface of said tie.

34. The inspection apparatus of claim 31 further comprising a rail plate pad configured to fit between said rail plate and said tie.

35. The inspection apparatus of claim 34 wherein said rail plate pad further comprises at least one aperture aligned with said rail plate aperture and adapted to accommodate said tie protrusion.

36. The inspection apparatus of claim 31 further comprising:

an elongated pin configured to fit through an eye in said at least one protrusion and to extend at least partially across said tie;

said pin being further configured to break when said misalignment causes said protrusion to recede from said aperture; and said pin comprising at least one extension configured to be visible in a first position outside said rail plate when said pin is intact, and being further configured to move to a second position when said pin breaks.

37. The inspection mechanism of claim 36 wherein said protrusion and said aperture are located within a recess in said rail plate.

38. The inspection mechanism of claim 37 wherein said recess is located under a rail seat of said rail plate.

* * * * *